US008995877B2

(12) United States Patent
Itabashi

(10) Patent No.: US 8,995,877 B2
(45) Date of Patent: Mar. 31, 2015

(54) PROCESS CARTRIDGE HAVING COVER FOR PROTECTING PHOTOSENSITIVE DRUM

(71) Applicant: Nao Itabashi, Nagoya (JP)

(72) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/685,066

(22) Filed: Nov. 26, 2012

(65) Prior Publication Data

US 2013/0136495 A1 May 30, 2013

(30) Foreign Application Priority Data

Nov. 30, 2011 (JP) ..... 2011-261253

(51) Int. Cl.
*G03G 21/18* (2006.01)

(52) U.S. Cl.
CPC ..... *G03G 21/1832* (2013.01); *G03G 21/1814* (2013.01)
USPC ..... 399/114; 399/113

(58) Field of Classification Search
CPC ..... G03G 21/1832; G03G 21/18
USPC ..... 399/114
See application file for complete search history.

(56) References Cited

U.S. PATENT DOCUMENTS 5,890,036 A * 3/1999 Karakama et al. ..... 399/119
5,937,242 A * 8/1999 Yokoyama et al. ..... 399/114
5,991,570 A * 11/1999 Haga et al. ..... 399/114
6,002,896 A * 12/1999 Miyamoto et al. ..... 399/114
6,097,911 A * 8/2000 Watanabe et al. ..... 399/114
7,826,767 B2 * 11/2010 Sato et al. ..... 399/113
2005/0069342 A1 * 3/2005 Kanno et al. ..... 399/111
2007/0206971 A1 9/2007 Yoshino
2008/0138110 A1 6/2008 Yoshino et al.
2009/0169257 A1 7/2009 Sato et al.
2010/0080621 A1 4/2010 Itabashi
2011/0286765 A1 * 11/2011 Murakami ..... 399/114

FOREIGN PATENT DOCUMENTS

JP 2010-079128 A 4/2010
JP 2011-075654 A 4/2011

OTHER PUBLICATIONS

First Office Action issued in corresponding Chinese Patent Application No. 201210480220.X, dated May 5, 2014.

* cited by examiner

*Primary Examiner* — Clayton E Laballe
*Assistant Examiner* — Ruifeng Pu
(74) *Attorney, Agent, or Firm* — Banner & Witcoff, Ltd.

(57) ABSTRACT

A process cartridge includes: a photosensitive member unit having a photosensitive member; a developing unit detachably mountable on the photosensitive member unit and having a developing roller; a movable member configured to move between a first position and a second position when the developing unit is mounted on the photosensitive member unit, the movable member at the first position permitting the photosensitive member and the developing roller to be in contact with each other and the movable member at the second position permitting the photosensitive member and the developing roller to be in separation from each other; and a covering member configured to cover the photosensitive member, the movable member being at the second position in a state where the covering member covers the photosensitive member.

10 Claims, 8 Drawing Sheets

PROCESS CARTRIDGE HAVING COVER FOR PROTECTING PHOTOSENSITIVE DRUM

CROSS REFERENCE TO RELATED APPLICATION

This application claims priority from Japanese Patent Application No. 2011-261253 filed Nov. 30, 2011. The entire content of the priority application is incorporated herein by reference.

TECHNICAL FIELD

The present invention relates to a process cartridge that is mountable in an electrophotographic image forming apparatus.

BACKGROUND

As a process cartridge mountable in an electrophotographic printer, there has been known a process cartridge including a photosensitive member for carrying a developer image, and a developing roller for supplying developer to the photosensitive member.

For example, there is proposed a process cartridge including: a process casing having a photosensitive drum; and a developing unit having a developing roller and detachably attachable to the process casing.

In this process cartridge, the developing unit is urged toward the photosensitive drum so that the developing roller is constantly in pressure contact with the photosensitive drum.

When this process cartridge is not mounted on a main body of a printer, a cover is put thereon so as to cover the photosensitive drum. The cover is provided with a pair of separation members designed to separate the developing roller from the photosensitive drum.

SUMMARY

In the above-described process cartridge, in order to separate the developing roller from the photosensitive drum, a user needs to place each separation member between the developing roller and the photosensitive drum before putting the cover over the photosensitive drum, making attachment of the cover complicated and cumbersome.

In view of the foregoing, it is an object of the present invention to provide a process cartridge and a covering member easily attachable thereto in a state where a developing roller is separated from a photosensitive member.

In order to attain the above and other objects, there is provided a process cartridge including a photosensitive member unit having a photosensitive member; a developing unit detachably mountable on the photosensitive member unit and having a developing roller; a movable member configured to move between a first position and a second position when the developing unit is mounted on the photosensitive member unit; and a covering member configured to cover the photosensitive member, the movable member being at the second position in a state where the covering member covers the photosensitive member. The movable member at the first position permits the photosensitive member and the developing roller to be in contact with each other and the movable member at the second position permits the photosensitive member and the developing roller to be in separation from each other.

BRIEF DESCRIPTION OF THE DRAWINGS

The particular features and advantages of the invention as well as other objects will become apparent from the following description taken in connection with the accompanying drawings, in which.

DETAILED DESCRIPTION

1. Overall Structure of the Printer

Figure 1:
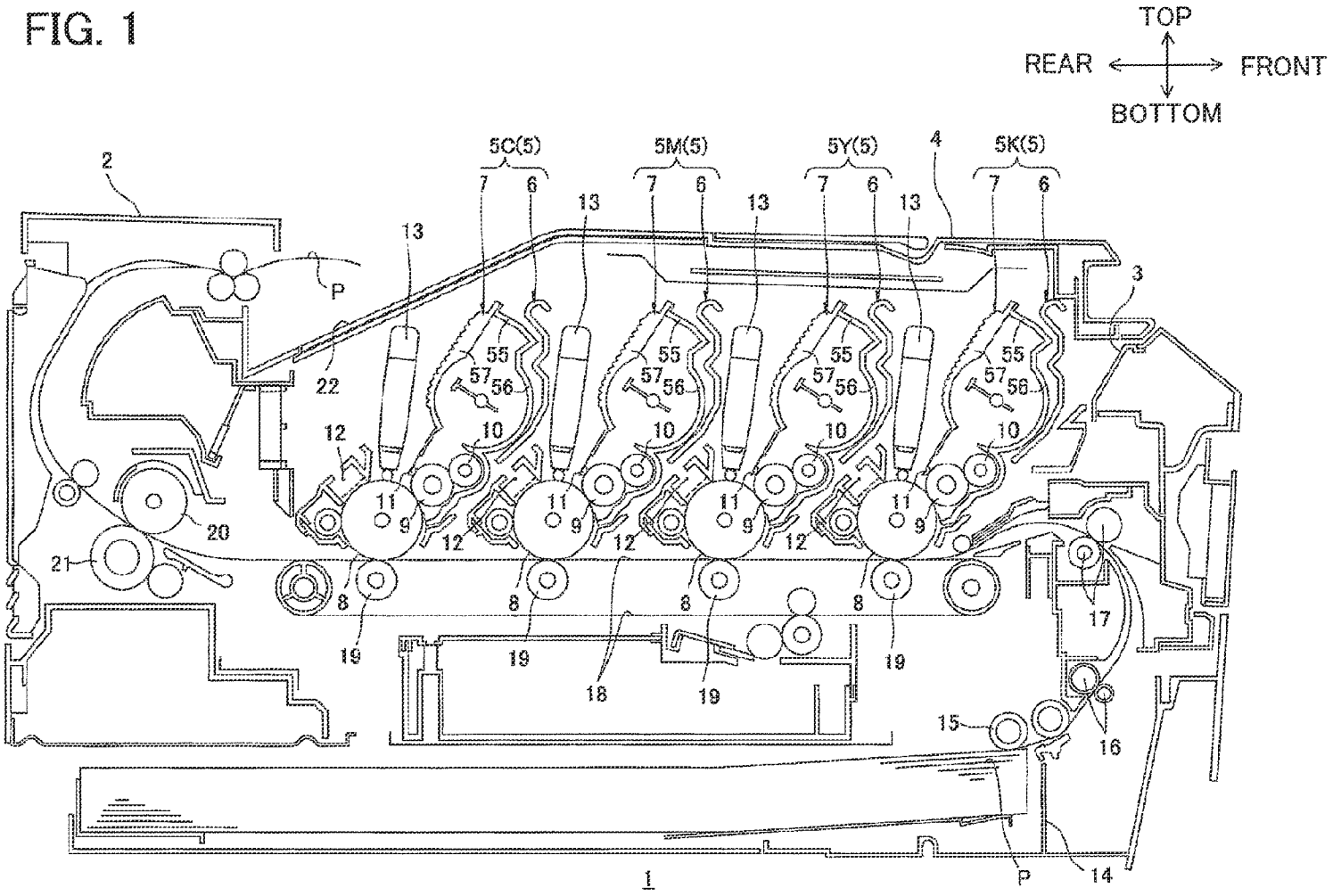
FIG. 1 is a central cross-sectional view of a printer that accommodates therein a process cartridge according to an embodiment of the present invention.

As shown in FIG. 1, a printer 1 is a horizontal direct tandem color printer. The printer 1 accommodates therein a plurality of process cartridges 5 according to an embodiment of the present invention.

In the following description, terms "upward", "downward", "upper", "lower", "above", "below", "beneath", "right", "left", "front", "rear" and the like will be used assuming that the printer 1 is disposed horizontally. Specifically, in FIG. 1, the right side is a front side, and a left side is a rear side of the printer 1. Further, "right side" and "left side" will be used when viewing the printer 1 from its front side. That is, the near side in FIG. 1 is the left side, and the far side in FIG. 1 is the right side of the printer 1.

Referring to FIG. 1, the printer 1 includes a main casing 2 having a substantially box-like shape. A top cover 4 is swingably provided at an upper end portion of the main casing 2 so as to open and cover a main body opening 3 formed in the main casing 2. The top cover 4 is pivotally movable about its rear end portion functioning as a fulcrum.

In the present embodiment, the printer 1 accommodates therein four process cartridges 5.

All the process cartridges 5 are detachably provided in the main casing 2. Each of the process cartridges 5 corresponds to one of four colors (black, yellow, magenta, and cyan) for use in the printer 1. From the front side to the rear side, the process cartridges 5 are juxtaposedly arrayed at intervals in an order of a black process cartridge 5K, a yellow process cartridge 5Y, a magenta process cartridge 5M, and a cyan process cartridge 5C.

Each process cartridge 5 includes a drum cartridge 6 and a developing cartridge 7 detachably mountable on the drum cartridge 6.

Each drum cartridge 6 includes a photosensitive drum 8. The photosensitive drum 8 is formed in a cylindrical shape extending in a left-right direction (or a lateral direction). The photosensitive drum 8 defines a central axis extending in the left-right direction and is rotatably supported to a drum frame 31 (described later) of the drum cartridge 6.

Each developing cartridge 7 includes a developing roller 9. The developing roller 9 is also cylindrical-shaped extending in the left-right direction and is rotatable supported to a cartridge frame 51 (described later) of the developing cartridge 7. The developing roller 9 is disposed at a rear end portion of the developing cartridge 7 so as to be exposed rearward therefrom. The developing roller 9 is in contact with the photosensitive drum 8 at a position frontward and upward thereof when the developing cartridge 7 is mounted on the drum cartridge 6.

Each developing cartridge 7 also includes a supply roller 10, a thickness regulation blade 11 and a toner container (shown without a reference numeral) disposed above the supply roller 10 and the thickness regulation blade 11. The supply roller 10 supplies toner to the developing roller 9, and the thickness regulation blade 11 regulates a thickness of the toner supplied to the developing roller 9.

Toner stored in the toner container of the developing cartridge 7 is positively tribocharged between the supply roller 10 and the developing roller 9, and is carried on a peripheral surface of the developing roller 9 as a thin layer of a uniform thickness by the thickness regulation blade 11.

A scorotron charger 12 and an LED unit 13 are disposed to oppose each photosensitive drum 8. Specifically, the scorotron charger 12 is disposed to face the corresponding photosensitive drum 8 from rear-upper side thereof, and the LED unit 13 is disposed to face the corresponding photosensitive drum 8 from above. The scorotron charger 12 applies a uniform charge to an outer peripheral surface of the photosensitive drum 8, and the LED unit 13 then exposes the outer peripheral surface to light based on image data, thereby forming an electrostatic latent image on the outer peripheral surface of the photosensitive drum 8.

As the developing roller 9 rotates, the toner carried on the peripheral surface of the developing roller 9 is supplied to the electrostatic latent image formed on the outer peripheral surface of the corresponding photosensitive drum 8. A toner image (developer image) is thus borne on the outer peripheral surface of each photosensitive drum 8.

Sheets P of paper are stacked in a sheet cassette 14 disposed at a bottom end portion of the main casing 2. A pickup roller 15, a sheet supply roller 16, and a pair of registration rollers 17 convey the sheets P upward and rearward one sheet at a time along a U-shaped sheet conveying path. Each sheet P is then supplied at a predetermined timing between the photosensitive drums 8 and an endless conveying belt 18 opposing the same. Four transfer rollers 19 are disposed at an internal space defined by the conveying belt 18 such that each transfer roller 19 opposes each photosensitive drum 8 via the conveying belt 18. While the sheet P is conveyed on the conveying belt 18 from the front side to the rear side between the photosensitive drums 8 and the transfer rollers 19, the toner image of each color is sequentially superimposed and transferred onto the sheet P. A color image is thus formed on each sheet P.

Subsequently, the sheet P passes between a heat roller 20 and a pressure roller 21 that are disposed rearward of the conveying belt 18, at which time the color image transferred onto the sheet P is thermally fixed thereto by heat and pressure.

The sheet P is then conveyed upward and frontward along a U-shaped sheet conveying path, and is discharged onto a discharge tray 22 formed on the top cover 4.

2. Process Cartridge

Figure 2:
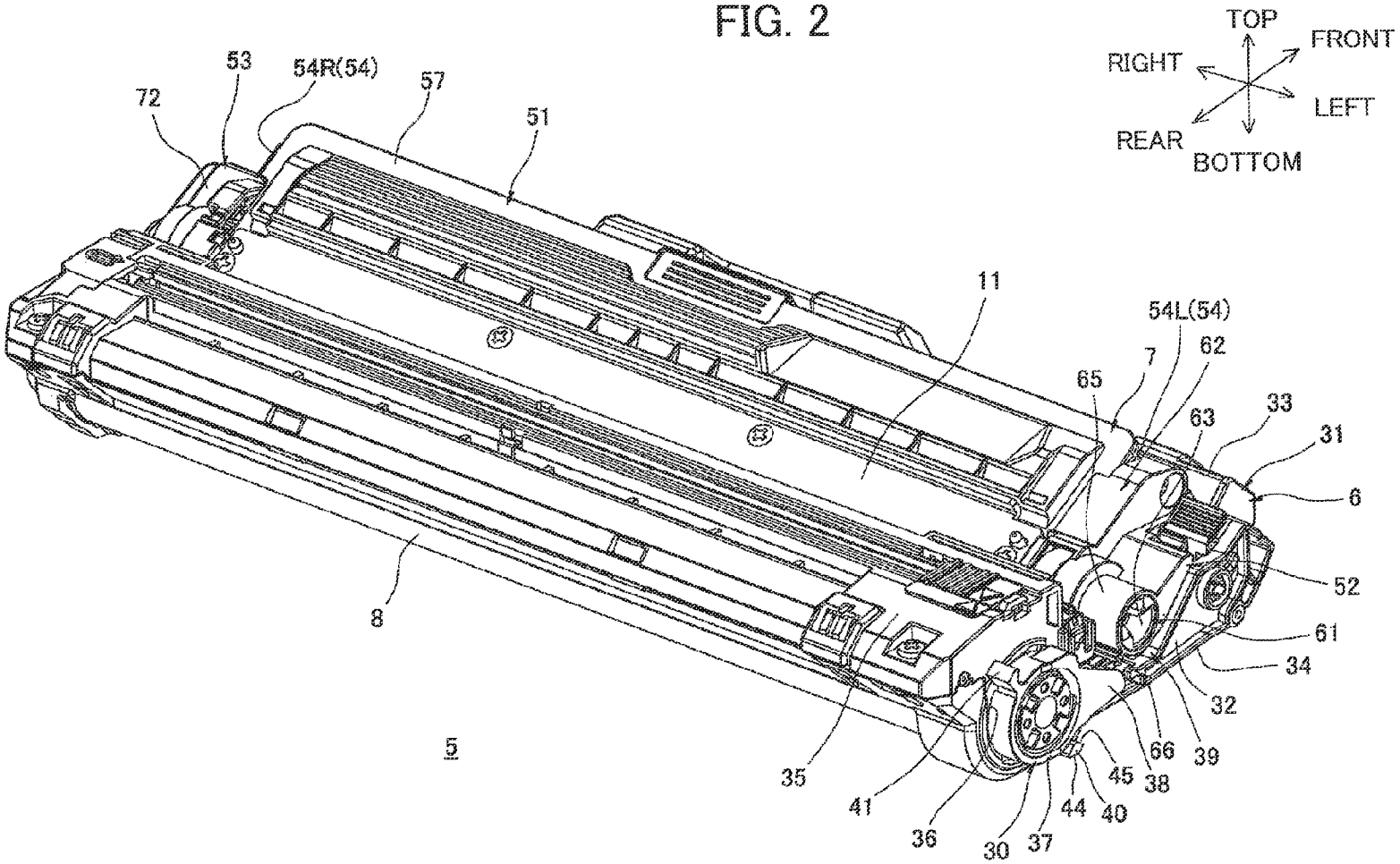
FIG. 2 is a perspective view of the process cartridge of FIG. 1 as viewed from its rear side and left side, the process cartridge including a drum cartridge having a bearing member and a photosensitive drum.

In the following description, orientations of the process cartridge 5 will be referred to assuming that the process cartridge 5 is disposed on a horizontal plane as shown in FIG. 2 such that a lower wall 34 of the drum cartridge 6 corresponds to the lower side of the process cartridge 5. The side on which the photosensitive drum 8 is disposed is defined as the rear side of the process cartridge 5.

(1) Drum Cartridge

As shown in FIG. 2, the drum cartridge 6 includes the drum frame 31, a pair of pressing members 42 (see FIG. 5), and a pair of bearing members 30.

(1-1) Drum Frame

The drum frame 31 is formed in a frame-like shape having a generally rectangular shape in a plan view, and is closed on its bottom side. More specifically, the drum frame 31 includes: left and right side walls 32; a front wall 33 spanning between front end portions of the two side walls 32; a lower wall 34 spanning between lower end portions of the two side walls 32; and an upper wall 35 spanning between upper-rear end portions of the two side walls 32.

Each side wall 32 has a substantially rectangular shape in a side view and extends in a front-rear direction. Each side wall 32 has a rear end portion in which a coupling hole 36 and a frame-side engaged portion 40 are formed. The bearing members 30 are coupled to the respective coupling holes 36, and second engagement portions 84 (described later) of a drum cover 81 (described later) are engaged with the respective frame-side engaged portions 40.

The coupling holes 36 are formed in a substantially circular shape in a side view to penetrate through the respective side walls 32 in the left-right direction. The coupling hole 36 has an inner diameter substantially equal to (or slightly larger than) an outer diameter of a bearing portion 37 (described later) of the corresponding bearing member 30.

The frame-side engaged portion 40 is formed in a generally rectangular columnar shape at a position frontward and downward of the coupling hole 36. The frame-side engaged portion 40 extends outward from an outer surface of the side wall 32 in the left-right direction. More specifically, each frame-side engaged portion 40 includes a sloped surface 44 and an engaging surface 45.

Figure 3:
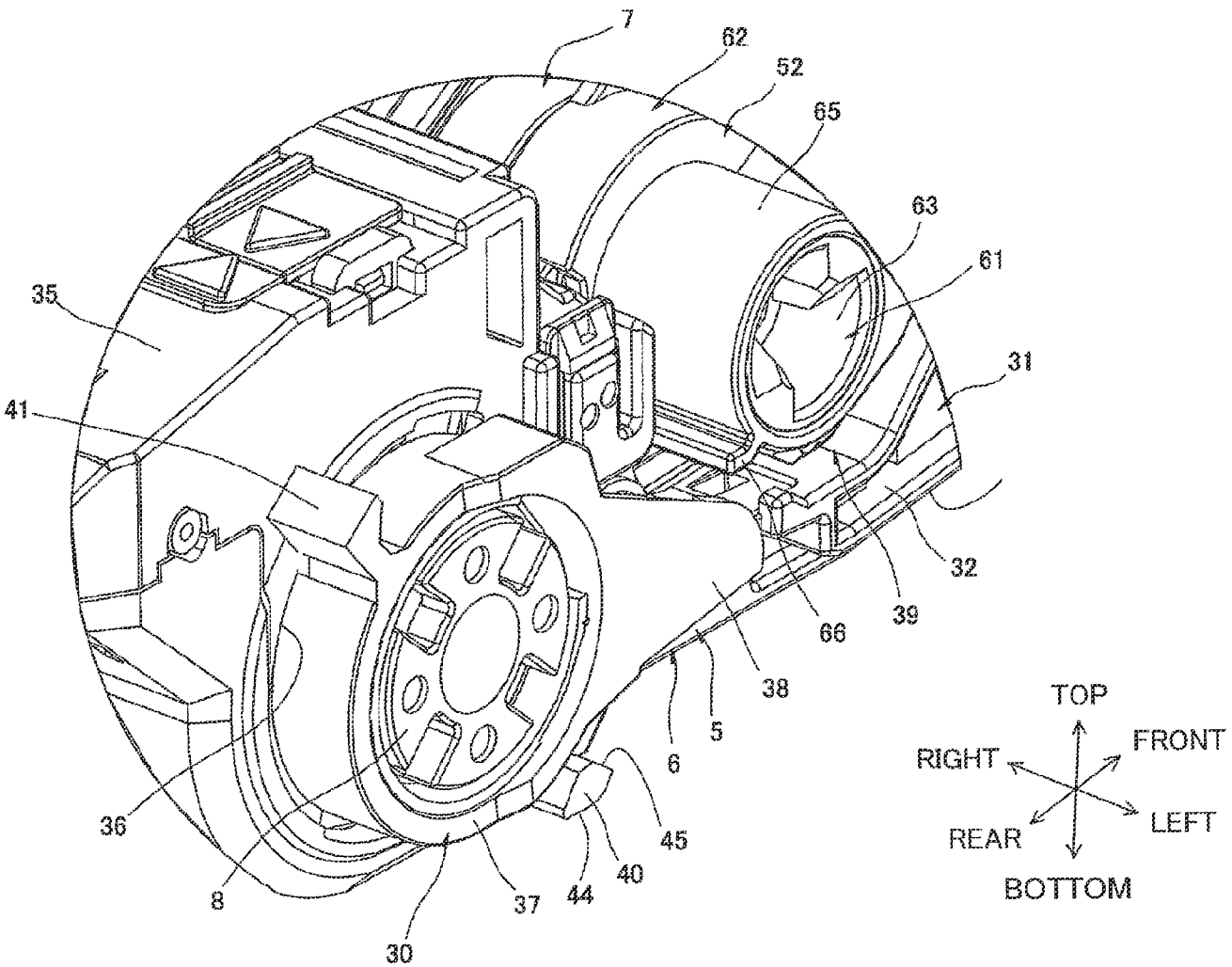
FIG. 3 is an enlarged view of an essential portion of the process cartridge of FIG. 2, the drum cartridge being formed with a second engagement portion and the bearing member having a first engagement portion.
Figure 5:
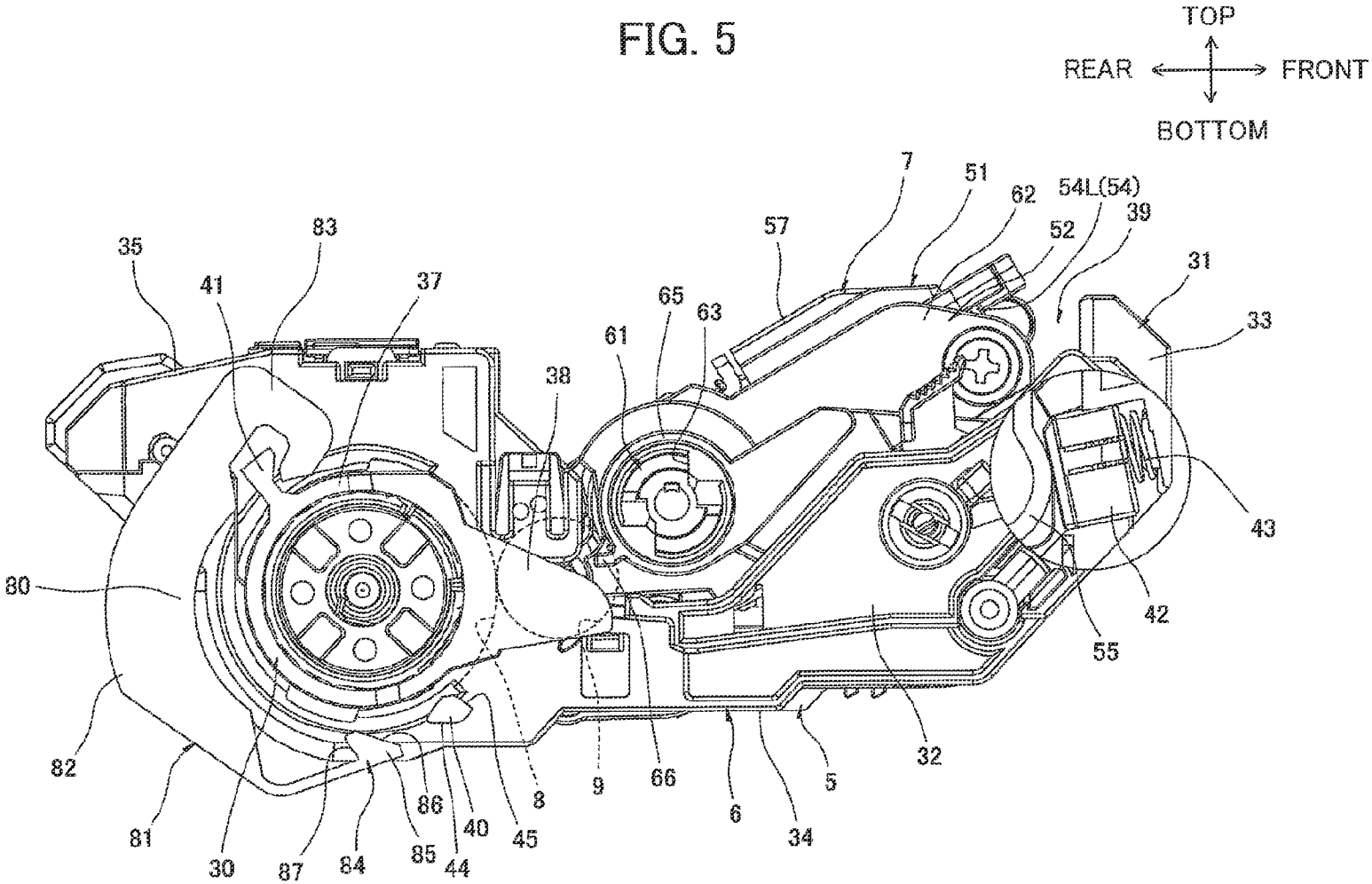
FIG. 5 is an explanatory view illustrating how the drum cover according to the embodiment is attached to the process cartridge of FIG. 2, wherein the bearing member is at a first position and the first engaging portion of the drum cover is engaged with the first engagement portion of the bearing member.

Referring to FIGS. 3 and 5, the sloped surface 44 constitutes a lower surface of the frame-side engaged portion 40 and extends in the front-rear direction. The sloped surface 44 slopes such that, as extending in a counterclockwise direction in a left side view with respect to the central axis of the photosensitive drum 8, the sloped surface 44 extends outward in a radial direction of the photosensitive drum 8.

The engaging surface 45 constitutes an upper-front surface of the frame-side engaged portion 40, and extends in the radial direction of the photosensitive drum 8.

The front wall 33 is formed in a substantially flat plate-like shape extending in the left-right direction.

The lower wall 34 is connected to a lower end portion of the front wall 33 and has a substantially flat plate-like shape extending in the front-rear direction and in the left-right direction.

The upper wall 35 is formed in a substantially flat plate-like shape extending in the left-right direction for covering the photosensitive drum 8 from above. The scorotron charger 12 is supported on a lower surface of the upper wall 35 (see FIG. 1).

In the drum frame 31, a developing cartridge accommodating portion 39 is defined for accommodating the developing cartridge 7 therein. Specifically, the developing cartridge accommodating portion 39 is defined by: a front-half portion of the lower wall 34; portions of the two side walls 32 corresponding to the front-half portion of the lower wall 34; the front wall 33; and a front edge portion of the upper wall 35.

(1-2) Pressing Members

As shown in FIG. 5, the pair of pressing members 42 are disposed on the front wall 33 of the drum frame 31 such that the pressing members 42 come into contact with a front wall 55 (described later) of the developing cartridge 7 from front side thereof.

The pressing members 42 are formed in a rectangular columnar shape extending in the front-rear direction. The pressing members 42 are supported on a rear surface of the front wall 33 so as to be slidable in the front-rear direction. The pressing members 42 are arranged on left and right end portions of the rear surface of the front wall 33.

A compression coil spring 43 is interposed between a front end portion of each pressing member 42 and the rear surface of the front wall 33. The compression coil springs 43 can expand and contract in a direction in which the pressing members 42 are slidable (i.e., the front-rear direction). With this structure, the pressing member 42 is constantly biased toward the rear side, thereby biasing the developing cartridge 7 rearward toward the photosensitive drum 8.

(1-3) Bearing Members

As shown in FIGS. 3 and 5, each bearing member 30 integrally includes the bearing portion 37, a bearing-side engaged portion 41, and a pressing portion 38.

The bearing portion 37 has a substantially cylindrical shape extending in the left-right direction. The bearing portion 37 has an inner diameter substantially equal to (or slightly larger than) an outer diameter of each lateral end portion of the photosensitive drum 8. The bearing portion 37 rotatably supports each lateral end portion of the photosensitive drum 8.

The bearing-side engaged portion 41 is formed in a substantially hook-like shape in a side view. The bearing-side engaged portion 41 extends diagonally upward and rearward from an upper-rear end portion of the bearing portion 37, and has an upper-rear end portion that is bent diagonally upward and frontward therefrom. The bearing-side engaged portion 41 is engageable with a first engagement portion 83 (described later) of the drum cover 81 (described later).

The pressing portion 38 is formed in a flat plate-like shape, having a certain thickness in the left-right direction. The pressing portion 38 protrudes frontward from a front end portion of the bearing portion 37. The pressing portion 38 has a front end portion that is curved downward toward the front side and is abuttable with a separation engagement portion 66 (described later) of the developing cartridge 7. The front end portion of the pressing portion 38 is thus adapted to press the developing cartridge 7 frontward.

The bearing portions 37 of the bearing members 30 are coupled to the right and left end portions of each photosensitive drum 8 from laterally outward thereof so as to be capable of rotating relative to the same. At the same time, the bearing portions 37 of the bearing members 30 are inserted into the respective coupling holes 36 of the both side walls 32 of the drum frame 31 such that the bearing members 30 can rotate relative to the coupling holes 36.

Figure 6:
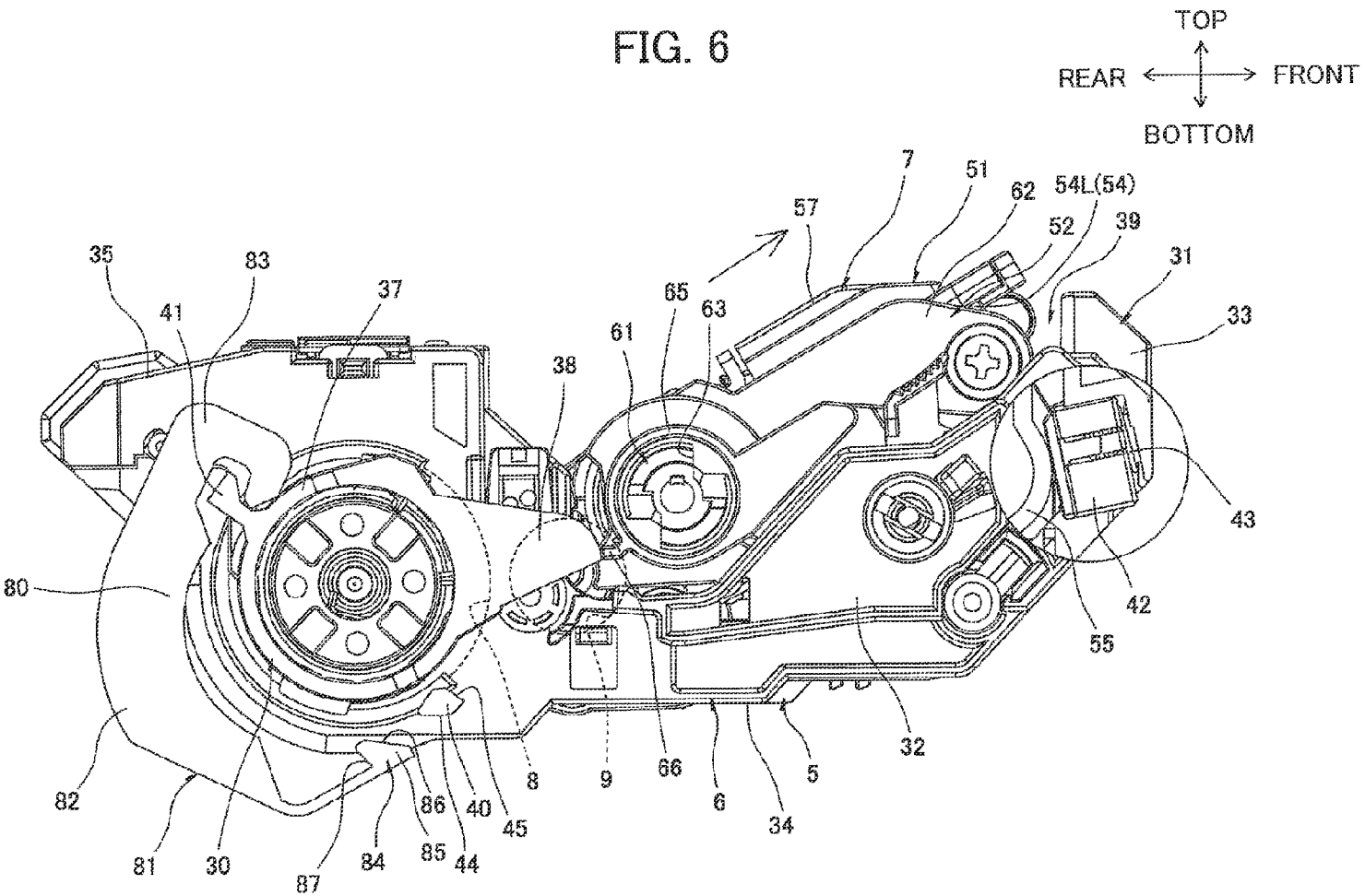
FIG. 6 is an explanatory view illustrating how the drum cover according to the embodiment is attached to the process cartridge of FIG. 2 after the state of FIG. 5, wherein the drum cover is moved downward to bring the bearing member at its second position.

With this structure, the bearing members 30 are rotatable about the central axis of the photosensitive drum 8 to be movable between a first position (shown in FIG. 5) and a second position (shown in FIG. 6). At the first position, the front end portion of the pressing portion 38 is positioned to oppose the separation engagement portion 66 (described later) of the developing cartridge 7 from rearward and downward thereof. At the second position, the front end portion of the pressing portion 38 is in abutment with the separation engagement portion 66 of the developing cartridge 7 and pushes the same frontward.

(2) Developing Cartridge

As shown in FIG. 2, the developing cartridge 7 includes the cartridge frame 51, a drive unit 52, and a detection unit 53. The drive unit 52 is placed on the left side of the cartridge frame 51, and the detection unit 53 is positioned on the right side of the cartridge frame 51.

(2-1) Cartridge Frame

The cartridge frame 51 is formed in a substantially box-like shape extending in the left-right direction. The cartridge frame 51 integrally includes left and right side walls 54, the front wall 55 (see FIG. 1), a lower wall 56 (see FIG. 1), and an upper wall 57. In the following description, the side wall 54 on the left side is referred to as "left side wall 54L" and the side wall 54 on the right side is referred to as "right side wall 54R".

The two side walls 54L, 54R are formed in a substantially rectangular shape in a side view and extend in the front-rear direction and in a top-down direction. The two side walls 54L, 54R are disposed in opposition to and in separation from each other in the left-right direction.

The front wall 55 extends in the left-right direction, and spans between front end portions of the two side walls 54L, 54R.

The lower wall 56 extends in the left-right direction, and spans between lower end portions of the two side walls 54L, 54R so as to be continuous with a lower end portion of the front wall 55.

The upper wall 57 is formed in a flat plate-like shape having a substantially rectangular shape in a plan view. The upper wall 57 is connected to frontward portions of the two side walls 54L, 54R and an upper end portion of the front wall 55. The upper wall 57 has a rear end portion on which the thickness regulation blade 11 is disposed to contact the developing roller 9 from above.

(2-2) Drive Unit

The drive unit 52 includes a developing coupling 61 and a drive-side gear cover 62.

The developing coupling 61 has a substantially columnar shape extending in the left-right direction. The developing coupling 61 is rotatably supported to the left side wall 54L. The developing coupling 61 has a left surface on which a coupling recessed portion 63 is formed.

The coupling recessed portion 63 is depressed rightward from the left surface of the developing coupling 61. The coupling recessed portion 63 has a generally elongated shape in a side view, extending in a radial direction of the developing coupling 61 and having a diametrically center portion which is narrow in width (see FIGS. 3 and 5). When the process cartridge 5 is mounted in the main casing 2, a tip end of a main body coupling (not shown) provided in the main casing 2 is inserted into the coupling recessed portion 63 so as to be incapable of rotating relative to the same. Thus, via the main body coupling (not shown), a rotational driving force is inputted into the developing coupling 61 from the main casing 2. The rotational driving force inputted into the developing coupling 61 is transmitted to the developing roller 9 and the supply roller 10 via a gear train (not shown).

The drive-side gear cover 62 is formed in a substantially rectangular cylindrical shape extending in the left-right direction. The drive-side gear cover 62 has its left end portion closed. The drive-side gear cover 62 includes a coupling collar 65 and the separation engagement portion 66.

The coupling collar 65 has a generally cylindrical shape, protruding leftward from a left wall of the drive-side gear cover 62 at a position substantially center thereof in the front-rear direction. The coupling collar 65 has a right end portion that is in communication with inside of the drive-side gear cover 62.

The separation engagement portion 66 is provided in a form of a rib, protruding rearward from a rear end portion of the coupling collar 65 and extending in the left-right direction. The separation engagement portion 66 has a rear surface extending in the top-down direction.

The drive-side gear cover 62 is screw-fixed to the left side wall 54L such that a left end portion of the developing coupling 61 is fitted with the coupling collar 65. The coupling recessed portion 63 is exposed from a left end portion of the coupling collar 65.

(2-3) Detection Unit

The detection unit 53 includes a detection-side gear cover 72.

The detection-side gear cover 72 is formed in a rectangular cylindrical shape extending in the left-right direction. The detection-side gear cover 72 has its right end portion closed. The detection-side gear cover 72 has a rear end portion on which provided is a separation engagement portion (not shown) having the same shape as that of the separation engagement portion 66 of the drive-side gear cover 62. The detection-side gear cover 72 is screw-fixed to the right side wall 54R such that the detection-side gear cover 72 accommodates therein a new-product detection gear (not shown). The new-product detection gear (not shown) is partially exposed from the detection-side gear cover 72.

When a new (unused) developing cartridge 7 is mounted in the main casing 2, the new-product detection gear (not shown) is configured to be rotated, by a predetermined amount, upon receipt of the rotational driving force transmitted from the developing coupling 61 via the gear train (not shown). This rotation of the new-product detection gear (not shown) is detected by detection means (not shown) disposed in the main casing 2. Specifically, a portion of the new-product detection gear exposed from the detection-side gear cover 72 is detected by the detection means (not shown). Based on the detection results, information on the developing cartridge 7 is determined at the printer 1, such as whether the mounted developing cartridge 7 is new, and specifications of the mounted developing cartridge 7.

3. Protection of the Photosensitive Drum (1) Drum Cover

The drum cover 81 is attached to a rear end portion of the drum frame 31 (see FIG. 8) for covering the photosensitive drum 8 to protect the same when the drum cartridge 6 is not mounted in the main casing 2.

In the following description, directions with regard to the drum cover 81 will be referred to, assuming that the drum cover 81 is attached to the drum frame 31 (the states shown in FIGS. 4 and 8).

The drum cover 81 is made of a resiliently deformable resin. Referring to FIG. 4, the drum cover 81 integrally includes a covering portion 82 and a pair of flange portions 80.

The covering portion 82 extends in the left-right direction and has a curved plate-like shape so as to be in conformance with an outer profile of the photosensitive drum 8. The covering portion 82 is formed so as to generally completely cover the photosensitive drum 8 from lower-rear side thereof when the drum cover 81 is attached to the process cartridge 5.

The flange portions 80 have a substantially flat plate-like shape. The flange portions 80 protrude frontward and upward from left and right end portions of the covering portion 82. Each flange portion 80 includes a first engagement portion 83 and a second engagement portion 84.

The first engagement portion 83 is formed in a substantially hook-like shape in a side view. The first engagement portion 83 extends frontward from an upper-end portion of the flange portion 80, and has a front end that is bent downward.

The second engagement portion 84 is formed in a substantially flat plate-like shape, extending frontward and upward from a lower end portion of the flange portion 80. The second engagement portion 84 has a width in the left-right direction and has a thickness in a direction parallel to a line connecting the upper-rear side and the lower-front side. The second engagement portion 84 is so configured as to be resiliently deformable in its thickness direction. Each second engagement portion 84 has a tip end portion (upper-front end portion) from which a claw portion 85 protrudes rearward and upward.

More specifically, the claw portion 85 is formed in a substantially right-angled triangular shape in a side view having an apex oriented upward and rearward. The claw portion 85 includes a sloped plane 86 and an engagement plane 87.

The sloped plane 86 extends rearward from the upper-front end portion of the second engagement portion 84. More specifically, the sloped plane 86 is sloped downward and rearward as extending upstream (toward the lower-rear side) in the extending direction of the second engagement portion 84 (or in the direction toward the upper-front side from the lower-rear side).

The engagement plane 87 extends frontward and downward from a rear end portion of the sloped plane 86. That is, the engagement plane 87 extends in the direction perpendicular to the extending direction of the second engagement portion 84.

(2) Attachment of the Drum Cover

Next, how the drum cover 81 is attached to the process cartridge 5 will be described with reference to FIGS. 5 to 8. Hereinafter, for simplifying explanation, mounting operations of the drum cover 81 will be described only on the left side of the process cartridge 5, since the same operations will be performed on the right side.

It should be noted that, when the drum cover 81 is not attached to the process cartridge 5 (see FIG. 2), the bearing member 30 is at the first position (see FIG. 5). When the bearing member 30 is at the first position, the developing roller 9 is in pressure-contact with the photosensitive drum 8 from frontward thereof due to a biasing force of the pressing members 42.

In order to attach the drum cover 81 to the process cartridge 5, as shown in FIG. 5, the first engagement portion 83 of the drum cover 81 is first engaged with the bearing-side engaged portion 41 of the bearing member 30 from above.

Then, as shown in FIG. 6, the drum cover 81 is moved downward, thereby angularly rotating the bearing member 30 about the central axis of the photosensitive drum 8 in the counterclockwise direction in a left side view.

Accordingly, the front end portion of the pressing portion 38 of the bearing member 30 comes into contact with a rear end portion of the separation engagement portion 66 of the developing cartridge 7 from below.

As the bearing member 30 is further rotated counterclockwise in a left side view as the drum cover 81 is further moved downward, the separation engagement portion 66 of the developing cartridge 7 is pushed frontward while slidingly moves on and along the curved front end portion of the pressing portion 38. The bearing member 30 is thus displaced to the second position from the first position.

As a result, the developing cartridge 7 is moved frontward against the biasing force applied from the pressing members 42 and the developing roller 9 is separated from the photosensitive drum 8. In other words, when the bearing member 30 is at the second position, the photosensitive drum 8 and the developing roller 9 are separated from each other. A separation direction of the developing cartridge 7 from the corresponding photosensitive drum 8 is indicated by an arrow in FIG. 6.

Figure 7:
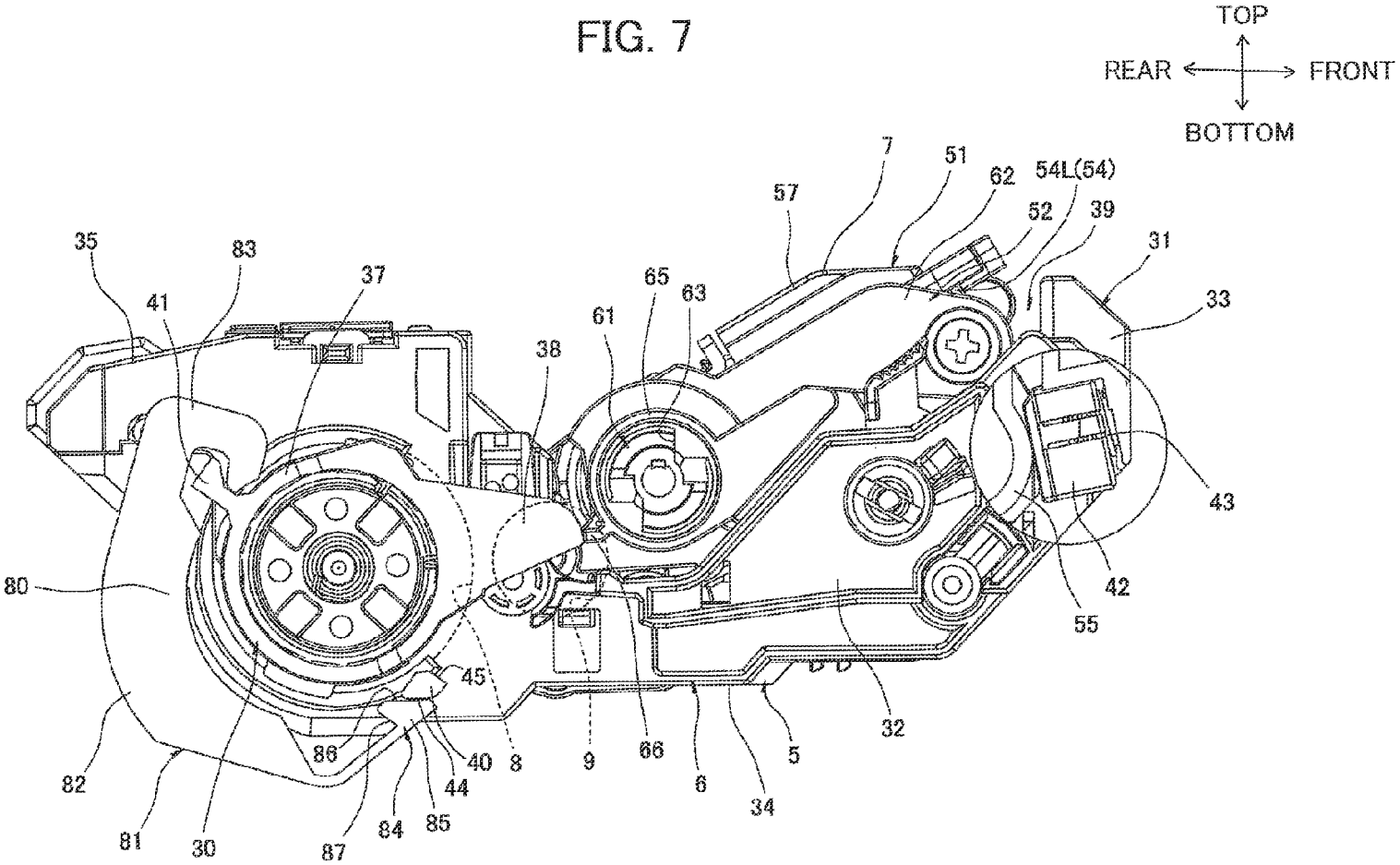
FIG. 7 is an explanatory view illustrating how the drum cover according to the embodiment is attached to the process cartridge of FIG. 2 after the state of FIG. 6, wherein the second engaging portion of the drum cover is brought into abutment with the second engagement portion of the drum cartridge.

Subsequently, in order to complete mounting of the drum cover 81 on the process cartridge 5, as shown in FIG. 7, the drum cover 81 is then pivotally moved counterclockwise in a left side view about the central axis of the photosensitive drum 8, while the bearing member 30 is kept at the second position.

The claw portion 85 of the second engagement portion 84 of the drum cover 81 thus comes into contact with the frame-side engaged portion 40 of the drum frame 31 from reward and downward thereof.

As the drum cover 81 is further pivotally moved counterclockwise in a left side view, the second engagement portion 84 is deformed outward in the radial direction of the photosensitive drum 8 such that the sloped plane 86 of the claw portion 85 slidingly moves on and along the sloped surface 44 of the frame-side engaged portion 40. The second engagement portion 84 thus climbs over the frame-side engaged portion 40.

After having climbed over the frame-side engaged portion 40, the second engagement portion 84 is restored to its original state because of resiliency thereof.

Figure 8:
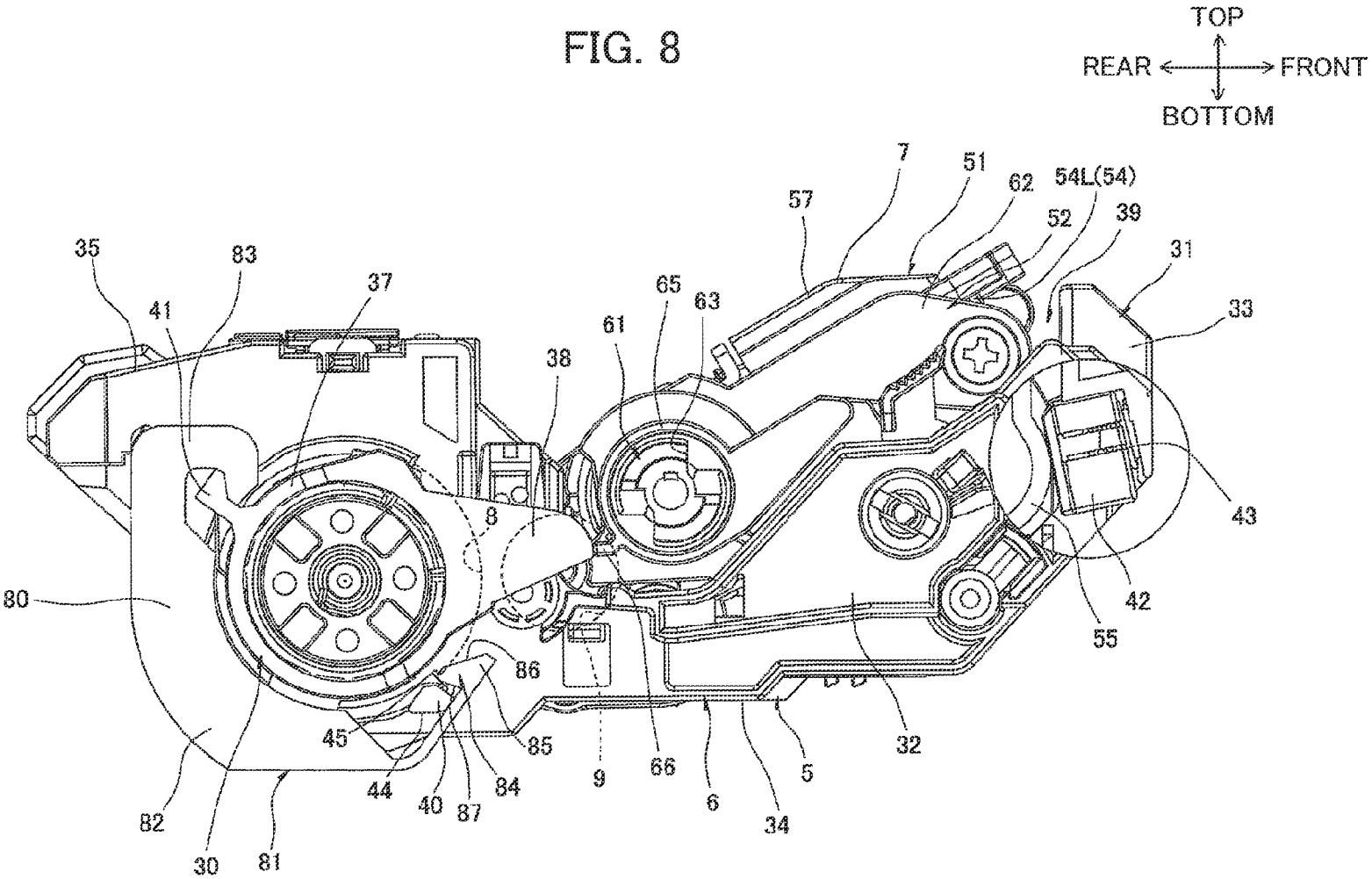
FIG. 8 is an explanatory view illustrating how the drum cover according to the embodiment is attached to the process cartridge of FIG. 2 after the state of FIG. 7, wherein the drum cover has been mounted on the process cartridge.

As a result, as shown in FIG. 8, the engagement plane 87 of the second engagement portion 84 faces the engaging surface 45 of the frame-side engaged portion 40, by which the second engagement portion 84 is engaged with the frame-side engaged portion 40.

In that manner, the bearing member 30 is fixed in position relative to the drum frame 31 through the drum cover 81, while being maintained at the second position. At this time, the photosensitive drum 8 is covered, from below and rearward thereof, by the covering portion 82 of the drum cover 81.

Attachment of the drum cover 81 to the process cartridge 5 is thus completed.

4. Operations and Technical Advantages (1) In the process cartridge 5 according to the present embodiment, as shown in FIG. 8, the photosensitive drum 8 and the developing roller 9 can be separated from each other by the bearing members 30 displaced to the second position by the drum cover 81. Hence, the drum cover 81 can be easily attached to the process cartridge 5 while keeping the developing roller 9 separated from the photosensitive drum 8.

Figure 4A:
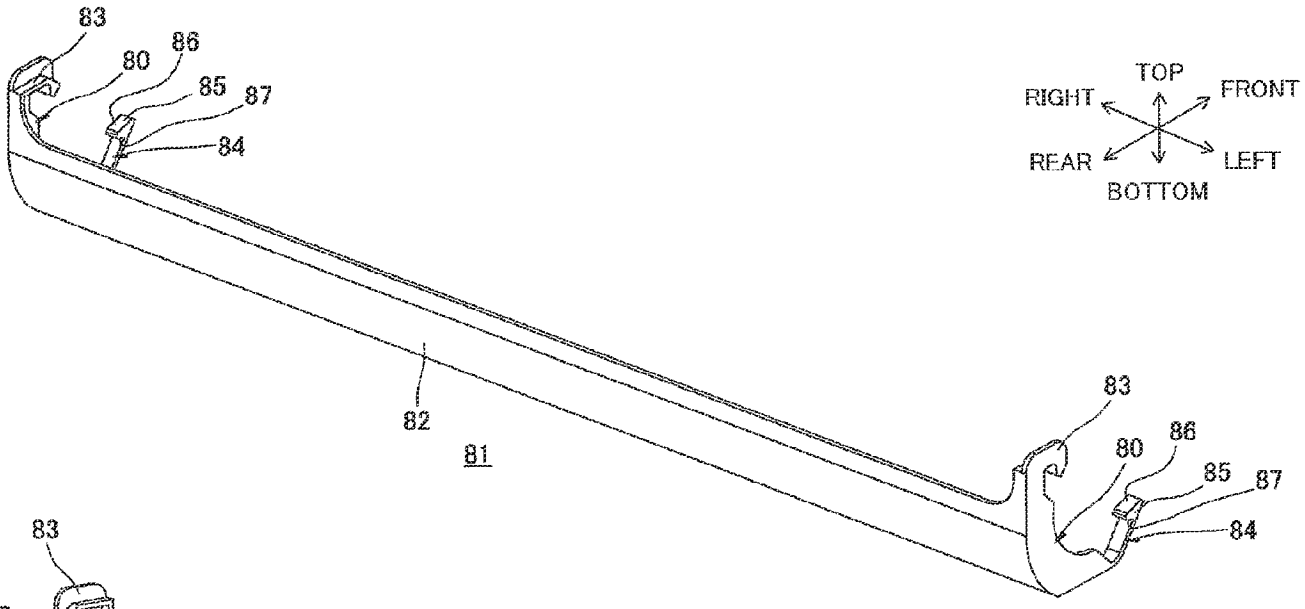
FIG. 4A is a perspective view of a drum cover according to the embodiment as viewed from its rear side and left side, the drum cover including a first engaging portion and a second engaging portion.
Figure 4B:
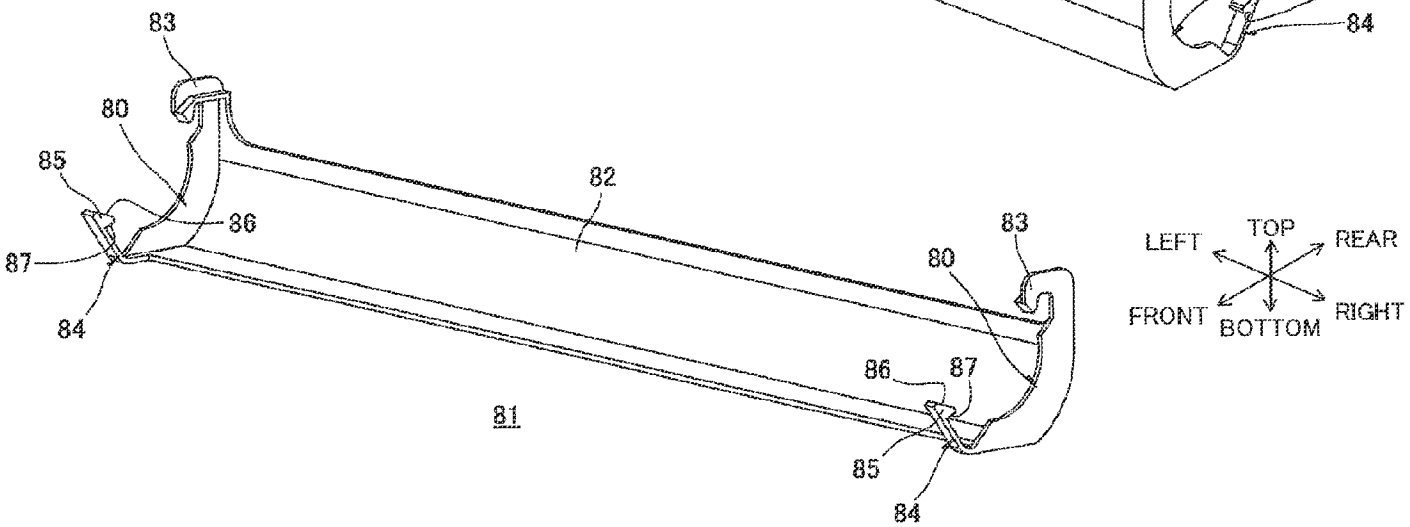
FIG. 4B is a perspective view of the drum cover according to the embodiment as viewed from its front side and right side.

(2) According to the process cartridge 5 of the present embodiment, as shown in FIGS. 4 and 8, the drum cover 81 can be sized in the front-rear direction to interfere with the bearing members 30 disposed to oppose the developing cartridge 7 from rearward thereof (or from upstream in the separation direction). In other words, due to interposition of the bearing members 30 between the drum cover 81 and the separation engagement portion 66, the drum cover 81 is not necessary to be made large enough to directly contact with the separation engagement portion 66 of the developing cartridge 7.

Therefore, unlike the conventional drum cover having separation members, the drum cover 81 of the present embodiment can be made smaller at least in the front-rear direction.

(3) According to the process cartridge 5 of the present embodiment, as shown in FIGS. 4 and 8, the bearing members 30 are disposed at both lateral end portions of the developing cartridge 7 so as to face each other in the left-right direction. The first engagement portions 83 are also provided at the both end portions of the drum cover 81 in the left-right direction.

Therefore, with help of the drum cover 81, the developing cartridge 7 can be separated from the photosensitive drum 8 in a stable and balanced manner in the left-right direction.

(4) According to the process cartridge 5 of the present embodiment, as shown in FIG. 2, the bearing members 30 are provided on the drum cartridge 6.

Therefore, with such a simple structure, the bearing members 30 are able to reliably act on the developing cartridge 7 that is mounted on the drum cartridge 6.

(5) According to the process cartridge 5, as shown in FIGS. 5 and 6, the bearing members 30 are angularly rotatable to move between the first position (see FIG. 5) and the second position (see FIG. 6).

In other words, such compact angular rotational movement of the bearing members 30 enables the bearing member 30 to move between the first position and the second position.

(6) According to the process cartridge 5, as shown in FIG. 8, during the operation of covering the photosensitive drum 8 with the drum cover 81, the bearing members 30 are displaced to the second position by engagement of the bearing-side engaged portions 41 with the first engagement portions 83. After being displaced to the second position, the bearing member 30 can be maintained at the second position by engagement of the second engagement portions 84 with the frame-side engaged portions 40.

(7) According to the process cartridge 5 of the present embodiment, the drum cover 81 is made of a resin having a resiliency.

Therefore, due to the resiliency of the drum cover 81 (specifically, the resiliency of the second engagement portions 84), the drum cover 81 is permitted to resiliently deform to be easily mounted on the process cartridge 5 to cover the photosensitive drum 8.

While the invention has been described in detail with reference to the embodiments thereof, it would be apparent to those skilled in the art that various changes and modifications may be made therein without departing from the spirit of the invention.

What is claimed is:

1. A process cartridge comprising:

a photosensitive member unit having a photosensitive member;

a developing unit detachably mountable on the photosensitive member unit and having a developing roller, the developing roller defining an axis extending in an axial direction;

a movable member configured to move between a first position and a second position when the developing unit is mounted on the photosensitive member unit, the movable member at the first position permitting the photosensitive member to contact the developing roller and the movable member at the second position causes the developing roller to separate from the photosensitive member in a separation direction perpendicular to the axial direction when the movable member is at the second position, the developing unit mounted in the photosensitive member unit being biased in a direction opposite to the separation direction, wherein the movable member comprises:

a bearing portion rotatably supported to the photosensitive member;

an engaged portion protruding radially outwardly from the bearing portion for engagement with a covering member; and a pressing portion protruding radially outwardly from the bearing portion and configured to push the developing unit away from the photosensitive member unit in the separation direction when the movable member is at the second position; and the covering member detachable from and attachable to the photosensitive member unit, the movable member being movable between the first position and the second position in association with attachment and detachment of the covering member relative to the photosensitive member unit, the covering member configured to cover the photosensitive member, the movable member being at the second position in a state where the covering member covers the photosensitive member.

2. The process cartridge according to claim 1, wherein the separation direction is further defined by a direction from the photosensitive member toward the developing roller, wherein the developing unit includes a first end portion in the axial direction, and the movable member is disposed upstream of the first end portion in the separation direction, and wherein the covering member includes an interfering portion configured to interfere with the movable member to move the movable member to the second position.

3. The process cartridge according to claim 2, wherein the developing unit further includes a second end portion opposite to the first end portion in the axial direction, wherein the movable member comprises a pair of movable parts, each of the pair of movable parts disposed to oppose each of the first end portion and the second end portion of the developing unit, and wherein the covering member extends in the axial direction and includes end portions in the axial direction, each of the end portions being provided with the interfering portion.

4. The process cartridge according to claim 1, wherein the movable member is provided on the photosensitive member unit.

5. The process cartridge according to claim 1, wherein the movable member is configured to be rotatable to move between the first position and the second position.

6. The process cartridge according to claim 1, wherein the covering member comprises:

an abutment portion configured to be engaged with the engaged portion to angularly rotate the movable member to the second position; and a retaining portion configured to be engaged with the photosensitive member unit when the movable member is moved to the second position to maintain the movable member in the second position, and to be disengaged from the photosensitive member unit when the movable member is moved to the first position.

7. The process cartridge according to claim 1, wherein the covering member is configured to be attached to the photosensitive member unit and comprises:

an abutment portion configured to be in abutment with the movable member to move the movable member to the second position upon attachment of the covering member to the photosensitive member unit; and a retaining portion configured to retain the movable member at the second position.

8. The process cartridge according to claim 1, wherein the covering member is made of a resiliently deformable resin.

9. The process cartridge according to claim 1, wherein the bearing portion is configured to move with the movable member relative to the photosensitive member unit when the movable member moves between the first and second positions.

10. The process cartridge according to claim 1, wherein the movable member is moved to the first position upon detachment of the covering member from the photosensitive member unit.

* * * * *